US005918682A

United States Patent [19]

Fan et al.

[11] Patent Number: 5,918,682

[45] Date of Patent: Jul. 6, 1999

[54] METHOD FOR DETERMINING A STEERING TECHNIQUE FOR AN EARTH MOVING MACHINE

[75] Inventors: Zhejun Fan, Dunlap; Thomas J. Kelly; Frank Lombardi, both of Peoria, all of Ill.

[73] Assignee: Caterpillar Inc., Peoria, Ill.

[21] Appl. No.: 08/909,169

[22] Filed: Aug. 11, 1997

[51] Int. Cl.[6] ..... E02F 3/76

[52] U.S. Cl. ..... 172/2; 172/4.5

[58] Field of Search ..... 172/1, 2, 3, 4, 172/4.5, 7, 9; 180/6.48, 6.5, 6.2, 6.7, 9.5, 119, 127, 333; 414/699, 912; 37/348; 364/424.07

[56] References Cited

U.S. PATENT DOCUMENTS 5,487,428 1/1996 Yamamoto et al. ..... 172/4.5
5,503,232 4/1996 Matsushita et al. ..... 172/2

*Primary Examiner*—Thomas B. Will
*Assistant Examiner*—Robert Pezzuto
*Attorney, Agent, or Firm*—Steve D. Lundquist; Wm. B. McPherson

[57] ABSTRACT

The present invention provides a method for selecting a steering method for an earthmoving machine having a blade and first and second tracks. One embodiment of the present invention includes selecting a steering method based on the position error of the machine. In another embodiment of the present invention the steering method is selected based on the elevation of the work implement, and the position error.

19 Claims, 9 Drawing Sheets

METHOD FOR DETERMINING A STEERING TECHNIQUE FOR AN EARTH MOVING MACHINE

TECHNICAL FIELD

This invention relates generally to determining a steering technique for an earth moving machine, and more particularly, a method for selecting a steering technique for an earth moving machine based on machine position error and blade elevation.

BACKGROUND ART

Increasing the efficiency of the operation of an earth moving machine is becoming increasingly important as land sites continue to monitor and reduce operating cost. One aspect of efficiently operating an earth moving machine on a land site is ensuring that the machine traverses the land site in an efficient manner. Several factors can cause an earth moving machine to stray from a desired course while operating on a land site. These factors include soil conditions, expected blade load versus actual blade load, etc. These factors can effect land site traversal regardless of whether the machine is operating in a manual, semi-autonomous, or autonomous mode. When a position error does occur, i.e., the machine strays from the desired course, there are multiple steering techniques which may be used to steer the machine back onto the desired course. These steering techniques include blade tilt steering and differential track speed steering. Each steering technique has advantages when compared to the other, based on the current conditions of the earth moving machine. Selecting which steering technique to use when a position error does occur impacts the overall efficiency of the machine.

The present invention is aimed at solving one or more of the problems as set forth above.

DISCLOSURE OF THE INVENTION

In one aspect of the present invention, a method for steering an earthmoving machine having a blade and a first and second track is provided. The method includes the steps of determining a current position and a desired position of the earth moving machine, comparing the current position and the desired position and responsively determining a position difference. The method further includes the step of steering the earthmoving machine by using either blade tilt steering or differential track speed steering in response to the position difference.

In another aspect of the present invention, a method for steering an earthmoving machine having a blade and a first and second track is provided. The method includes the steps of determining a current and desired position of said earth moving machine, and comparing the current position and said desired position and responsively determining a position difference. In addition, the method includes the steps of determining a position of said blade, comparing the position of the blade and a blade elevation threshold and responsively determining a blade elevation difference In addition the method includes the step of steering the earthmoving machine by one of blade tilt steering and differential track speed steering in response to the blade elevation difference.

In another aspect of the present invention, a method for steering an earthmoving machine having a blade and a first and second track is provided. The method includes the steps of determining a current position and a desired position of the earth moving machine, comparing the current position and the desired position and responsively determining a position difference. The method further includes the step of displaying a steering recommendation to an operator of the earthmoving machine in response to the position difference.

In another aspect of the present invention, a method for steering an earthmoving machine having a blade and a first and second track is provided. The method includes the steps of determining a current and desired position of said earth moving machine, and comparing the current position and said desired position and responsively determining a position difference. In addition, the method includes the steps of determining a position of said blade, comparing the position of the blade and a blade elevation threshold and responsively determining a blade elevation difference. The method further includes the step of displaying a steering recommendation to an operator of the earthmoving machine in response to the blade elevation difference.

BEST MODE FOR CARRYING OUT THE INVENTION

Figure 1:
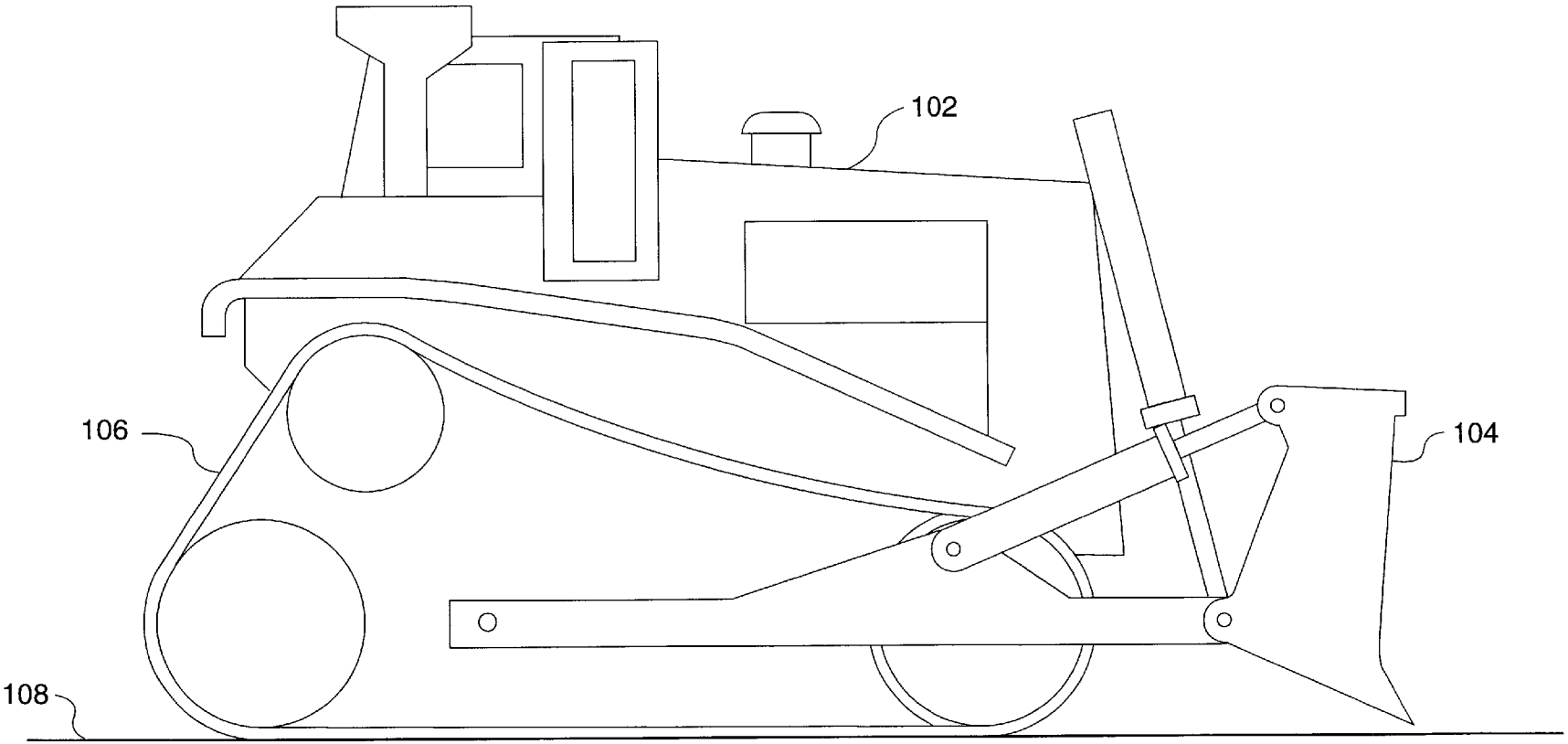
FIG. 1 is a diagrammatic illustration of an earthmoving machine operating at a land site.

With reference to FIG. 1, the present invention provides a method for steering an earthmoving machine 102. The earthmoving machine 102 includes a blade 104 and a first and second track 106 (only one track is shown).

The earthmoving machine 102 may be manually, autonomously, or semi-autonomously operated to traverse the land site 108. Although the earthmoving machine 102 is shown as a track type tractor, other types of tracked earthmoving machines may be substituted without departing from the spirit of the invention.

Figure 2:
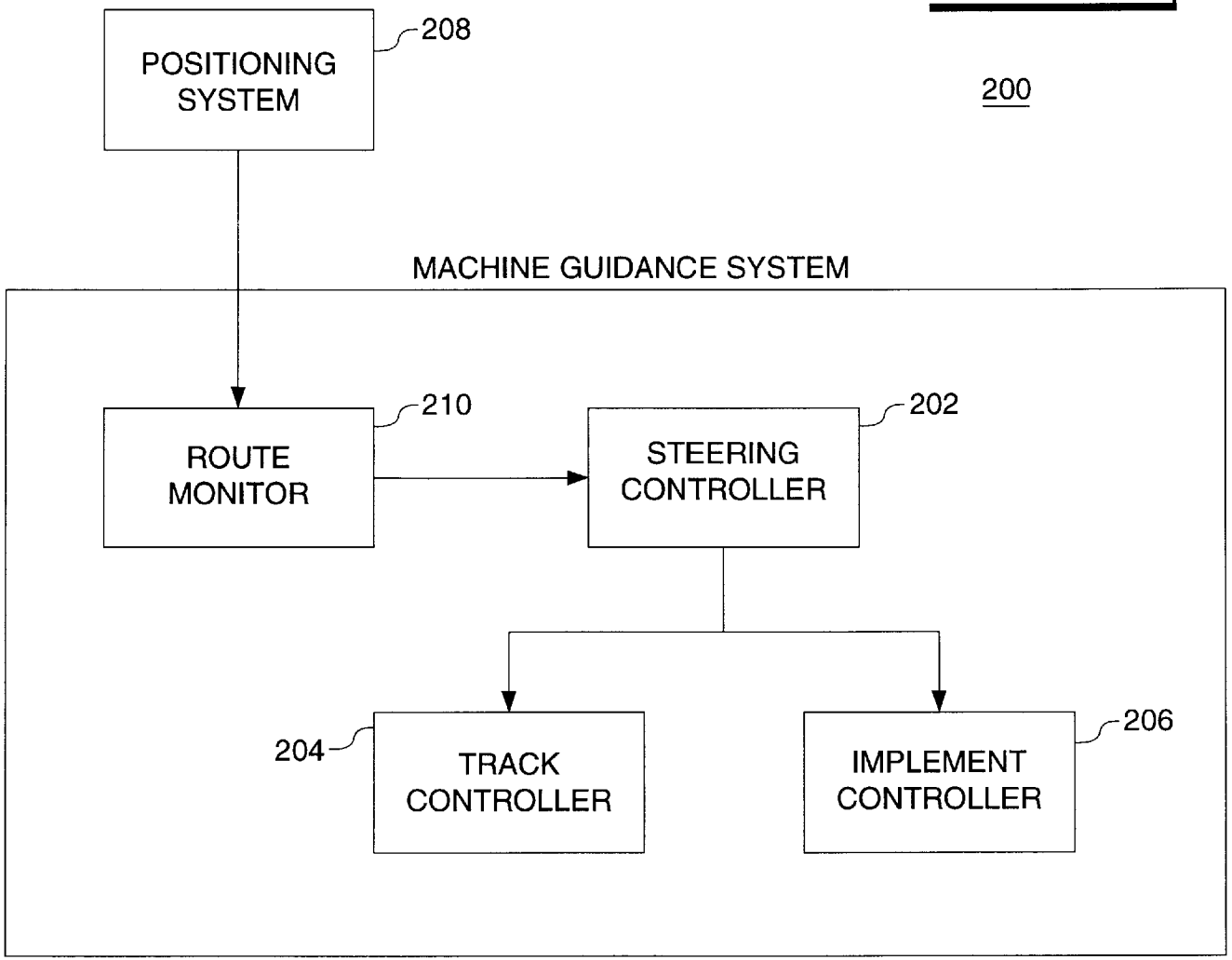
FIG. 2 is a block diagram of an apparatus for performing the present invention.

With reference to FIG. 2, the present invention includes a machine guidance system 200. The machine guidance system 200 includes a steering controller 202, a track controller 204, an implement controller 206, and a route monitor 210. The track controller 204 receives steering commands from the steering controller 202 and implements the commands by controlling the tracks 106 of the machine 102.

Figure 3:
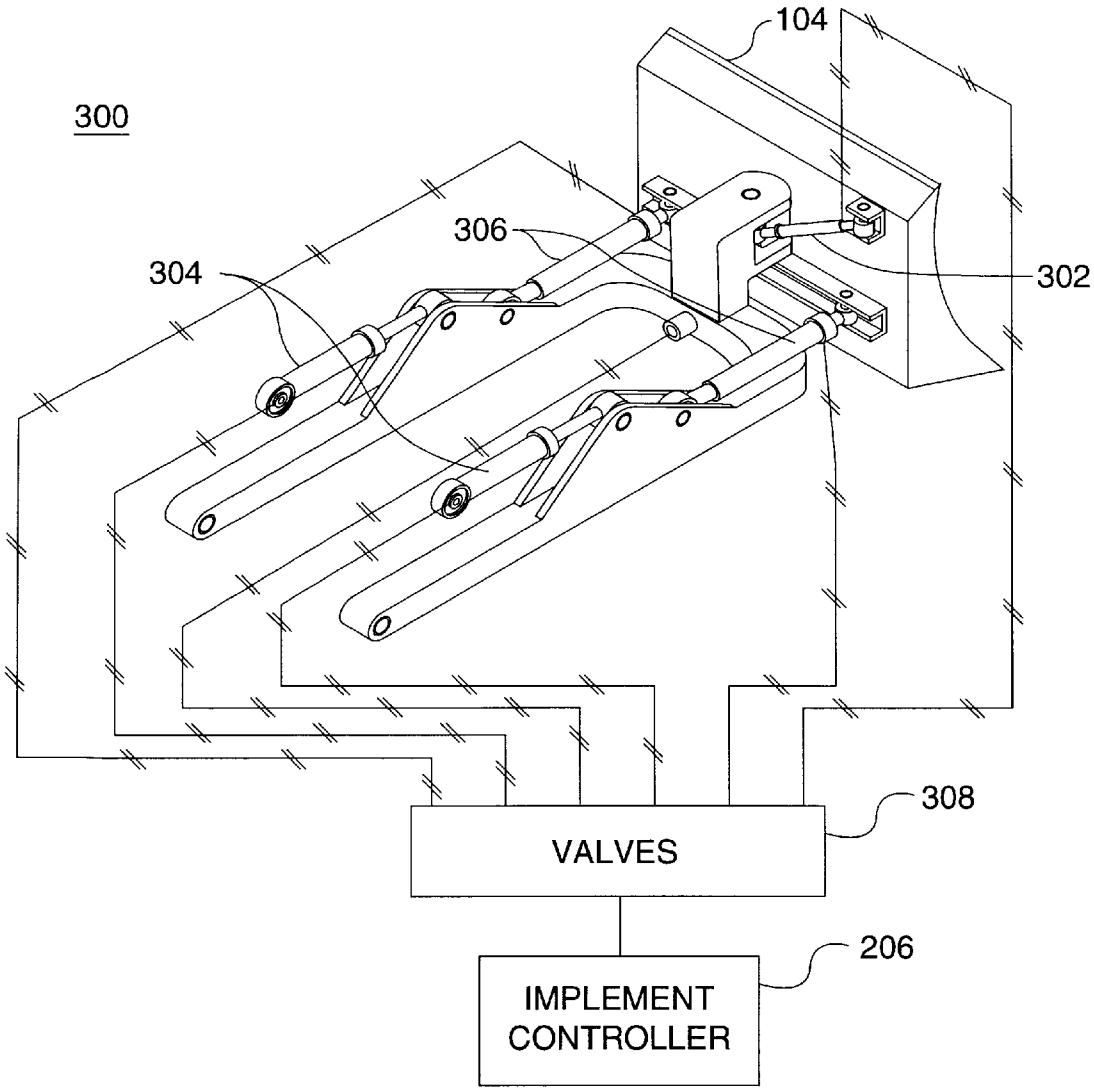
FIG. 3 is a diagrammatic illustration of a blade and associated tilt, lift, and angle cylinders.

The implement controller 206 receives implement control commands and converts the commands into the appropriate signals to manipulate the work implement 104. For example, FIG. 3 illustrates a blade 104 connected to a hydraulic system 300, which includes a tilt cylinder 302, lift cylinder 304, and an angle cylinder 306. In the preferred embodiment, when the machine 102 uses blade tilt steering, the work implement controller 204 receives a control command and converts the command to the necessary signals thereby controlling the lift, tilt and angular cylinders 302, 304, 306, to position the blade 104 appropriately. Preferably, the steering controller 202 is implemented in software and executed on a microprocessor based system (not shown) that includes random access memory (not shown) and read only memory (not shown).

A positioning system 208, shown in FIG. 2, determines the position of the machine 102 with respect to either a global reference system or a local reference system (not shown). In the preferred embodiment the calculations referred to in the present invention are made in the local coordinate system. Using a local coordinate system will reduce the complexity of the calculations when, for example, the machine 102 is located on a hill. The positioning system 208 may include any suitable positioning means, for example, a Global Positioning System (GPS), a laser plane based system or any other suitable system or combination thereof. The positioning system 208 may also include additional sensors (not shown) to enhance the accuracy of the position estimate, for example, an ultrasonic sensor located on the machine 102. In the preferred embodiment the positioning system 208 includes a GPS and an Inertial Navigation System (INS) (not shown). An INS system enables the machine 102 to continually receive positioning information. Continuous position information is beneficial in the event the GPS signals are not being received. For example, if the GPS signal are blocked due to mountain ranges, the machine 102 still has access to INS positioning information. The INS system also provides more frequent position updates than the GPS.

In the preferred embodiment the route monitor 210 is responsible for determining the desired path that the machine 102 follows as the machine 102 traverses the land site 108. The desired position of the machine 102 at a given time is based on the desired path the machine 102 is to follow. The desired path is represented by a parametric representation that connects two points in a three dimensional sphere based on a B-spline curve. The route monitor 210 may be located either on, or off the machine 102, eg, located at a base station (not shown), on a separate earth moving machine, or on a separate computing machine (not shown). If the route monitor 210 is located off the machine 102 then the route planner 210 communicates with the steering controller 202 via a communication means such as a wireless communication system (not shown).

Figure 4:
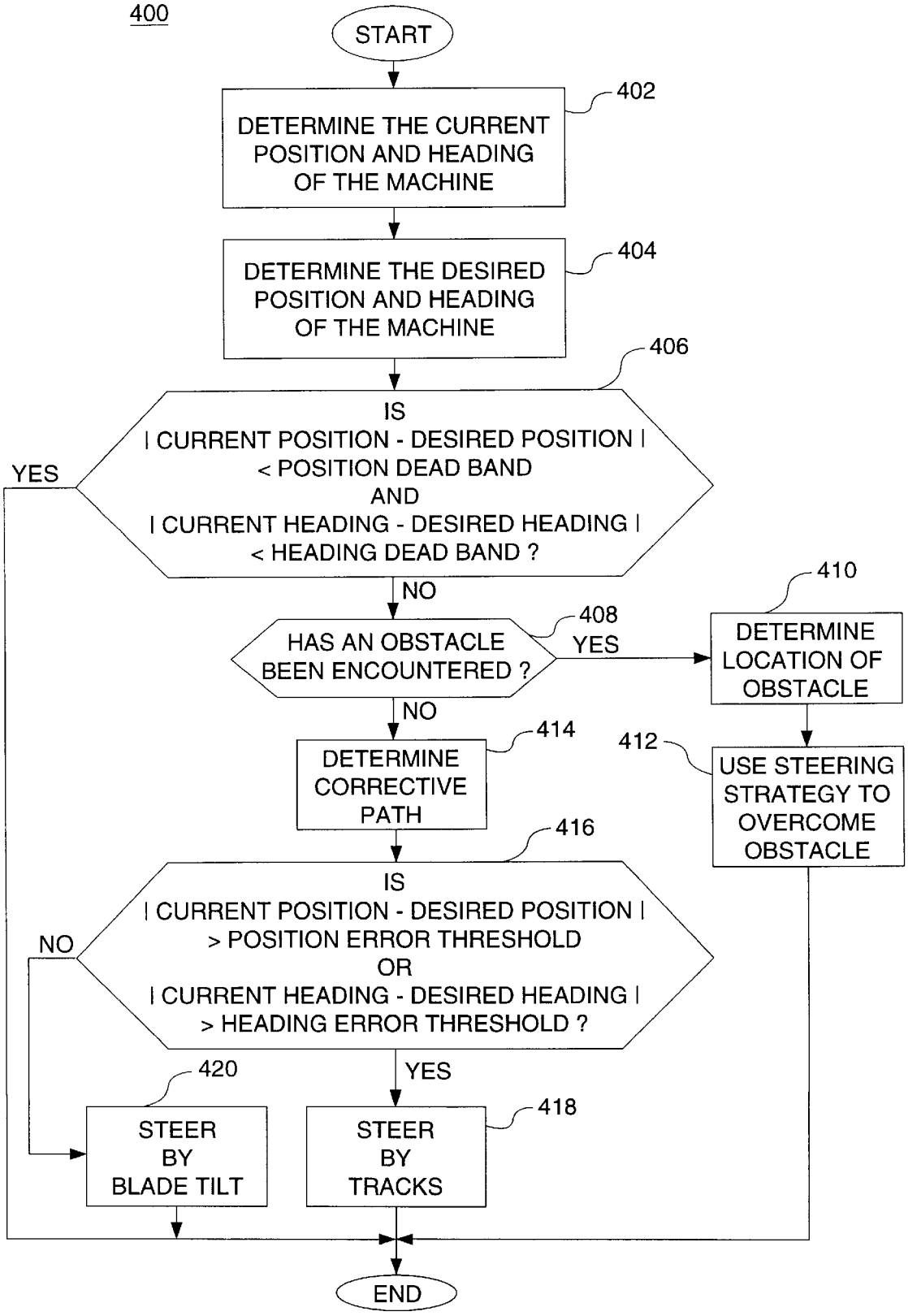
FIG. 4 is a flow diagram illustrating one embodiment of the present invention.
Figure 5:
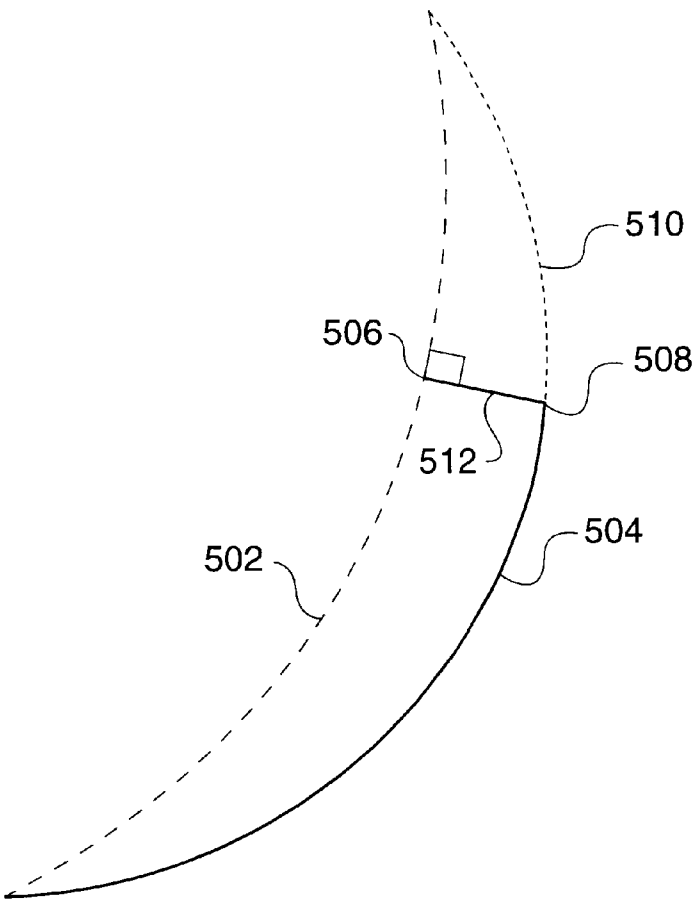
FIG. 5 is a diagrammatic illustration of a land site with a current and desired path.

During the operation of the machine 102 on a land site 108, there are two primary methods of steering: blade tilt steering, and differential track speed steering. With reference to FIG. 4, a flow diagram illustrating one embodiment of the present invention for determining a steering technique to use based on position error, is shown. In a first control block 402, the current position and heading of the machine are determined. The current position and heading are determined by the positioning system 208. In a second control block 404, the desired position and heading of the machine 102 are determined. The desired position and heading are determined by the route monitor 210 and communicated to the steering controller 202. In the preferred embodiment, the desired position 506 is determined by comparing the desired path 502 with the actual path 504, as shown in FIG. 5. The desired position 506 is determined by measuring the shortest path 512 between the current position 508 and the desired path 502. The desired position 506 is located at the intersection of the shortest path 512 to the desired path 502, and the desired path 502. An alternative method for determining the desired position 506 is by tracking the desired progress along a desired path 502 based on machine speed and elapsed time.

In a first decision block 406, the current position is compared with the desired position. In addition, the current heading is compared with the desired heading. If the difference between the current and desired position is less than a position deadband, and if the difference between the current and desired heading is less than an heading deadband, then no correction for either the position or the heading is currently needed. Accordingly, control passes to the end of the method 400. The position difference deadband and the heading difference deadband represent minimum values that should be exceeded before corrective action is deemed to be necessary. Once control reaches the end of the method 400, the method 400 is repeated.

However, if the position difference is not less than a position deadband, or the heading difference is not less than an heading deadband, then control passes to a second decision block 408 to determine if the machine 102 has encountered an obstacle.

During the manipulation of a land site 108 the machine 102 is likely to encounter obstacles such as rocks. Depending on the size and location of the rock different solutions may be used to overcome the rock. These solutions include driving over the rock, digging up the rock, cutting through the rock and driving around the rock. Therefore, in the second decision block 408, a determination is made regarding whether an obstacle was encountered. Methods to detect whether an obstacle has been encountered include monitoring the position and heading of the machine 102, and the load of the engine of the machine 102. If there is a sudden and substantial change in the heading from the previous reading to the current reading with little or no change in the position reading, then there is a strong likelihood that an obstacle has been encountered. For example, if the left front portion of the blade 104 hits a rock, the likely result is that the heading of the machine 102 will change as the machine 102 rotates to the left around the point on the blade 104 that the rock is located. However, as the machine 102 rotates to the left, there is little change in the actual position of the machine.

However, if the blade 104 encounters a rock located in the middle portion of the blade 104, the most noticeable result may be an increase in engine load as the machine 104 attempts to drive through the rock. Therefore, if either of these conditions exist, a sudden increase in engine load, or a sudden change in heading, then a determination is made that an obstacle has been encountered and control proceeds to a third control block 410 to determine the location of the obstacle.

In a third control block 410 a simple determination is made regarding the location of the obstacle relative to the blade 104. If the heading changed suddenly, then the determination is made that the rock is located on the side of the blade 104 that the machine 102 is turning towards. For example, as stated above, if the machine 102 is rotating to the left, then the assumption is that the rock is located on the left portion of the blade 104.

If the machine 102 is experiencing a sudden change in the engine load, then the assumption is that the rock is located in the middle portion of the blade. Once the determination is made regarding the location of the rock, then control proceeds to a fourth control block 412 to use an appropriate steering strategy, based upon the location of the rock, to overcome the rock.

In the preferred embodiment, when the rock is located in the middle portion of the blade, the first step is raise the blade slightly to see if the machine 102 can simply drive over the rock. The desired goal is to overcome the rock while maintaining the load on the blade that existed prior to encountering the rock. Therefore only a slight raise in the blade 104 is performed to overcome the rock. If the rock is to big to be driven over in this manner, then the next step is to back up and reduce the load of the blade, and then attempt to either dig the rock out, or cut the top of the rock off. If attempting to dig the rock out or cut the top of the rock off fails, then as a last resort, a route is determined by the route monitor 210 that will take the machine 102 around the rock.

If the rock is encountered on either the left or right portion of the blade 104, then the load of the blade 104 is reduced, and an attempt is made to dig the rock out. If digging the rock out does not work, then an attempt is made to tilt the blade 104 slightly so that the portion of the blade 104 located where the rock is, may be able to go over the rock. If tilting the blade 104 does not enable the machine 102 to overcome the rock, then the machine 102 will back up slightly and steer by differential track speed or blade tilt such that the heading of the machine 102 changes enough that the machine 102 is able to drive around the rock. Once an obstacle has been overcome, control proceeds to the end of the method 400.

When an obstacle is encountered, such as a rock, unless the obstacle is successfully removed, eg., digging out the rock, then the machine 102 transmits information to the operator, either on-board or off board, indicating the location of the obstacle so that other measures can be taken to remove the obstacle.

Referring again to the second decision block 408, if an obstacle has not been encountered, then control proceeds to a fifth control block 414, and a corrective path is determined.

In the fifth control block 414 a corrective path for the earth moving machine 102 is determined. In the preferred embodiment, a corrective path 510 is determined that enables the machine 102 to return to the desired path by using the smoothest path 510, not necessarily the shortest path 512, as FIG. 5 illustrates. The smoothest path enables the machine to transition back to the desired path without disrupting the current work function, for example by requiring ninety degree turns etc., to take the shortest path. In the preferred embodiment, the fifth control block 414 also determines the magnitude of the position error. If the magnitude of the error exceeds a maximum error threshold, then a warning flag is set. The maximum error threshold represents a maximum error that, if exceed, indicates that there is a significant problem related to the machine guidance system 200. That is, for the machine 102 to have diverged that much from the desired path, there must be a significant problem, such as a positioning system 208 malfunction, or a track controller 204 or implement controller 206 malfunction, or an obstacle on the land site 108 has been encountered. The warning flag may be used to indicate to the operator, either on board or off board, that a significant problem has occurred. In the preferred embodiment, notification to either the on board or off board operator is performed by displaying a position error message to the operator. The position error message may include the position and heading error, the likely sources of the error, and recommendations to overcome the error. In addition, the warning flag may be used by the machine guidance system 200 to execute diagnostics on the machines 102 hardware systems. An example of the maximum error threshold includes a 4 meter position error. Referring to FIG. 4, once a corrective path is determined, control then passes to a third decision block 416.

In the third decision block 416, if the difference between the current and desired position is greater than a position error threshold, or if the difference between the current and desired heading is greater than an heading error threshold, then control passes to a sixth control block 418 and the machine 102 is steered by differential track speed. However, if the difference between the current and desired position is not greater than a position error threshold, and, if the difference between the current and desired heading is not greater than an heading threshold, then control passes to a seventh control block 420 and the machine 102 is steered by using the technique of steering by blade tilt. The position error threshold and heading error threshold are thresholds which, in this embodiment of the present invention, distinguish between the position or heading error being large or small. The embodiment of the present invention described in FIG. 4 uses differential track speed to correct the position or heading error, when there is a large error, and blade tilt steering when there is a small error.

Figure 6:
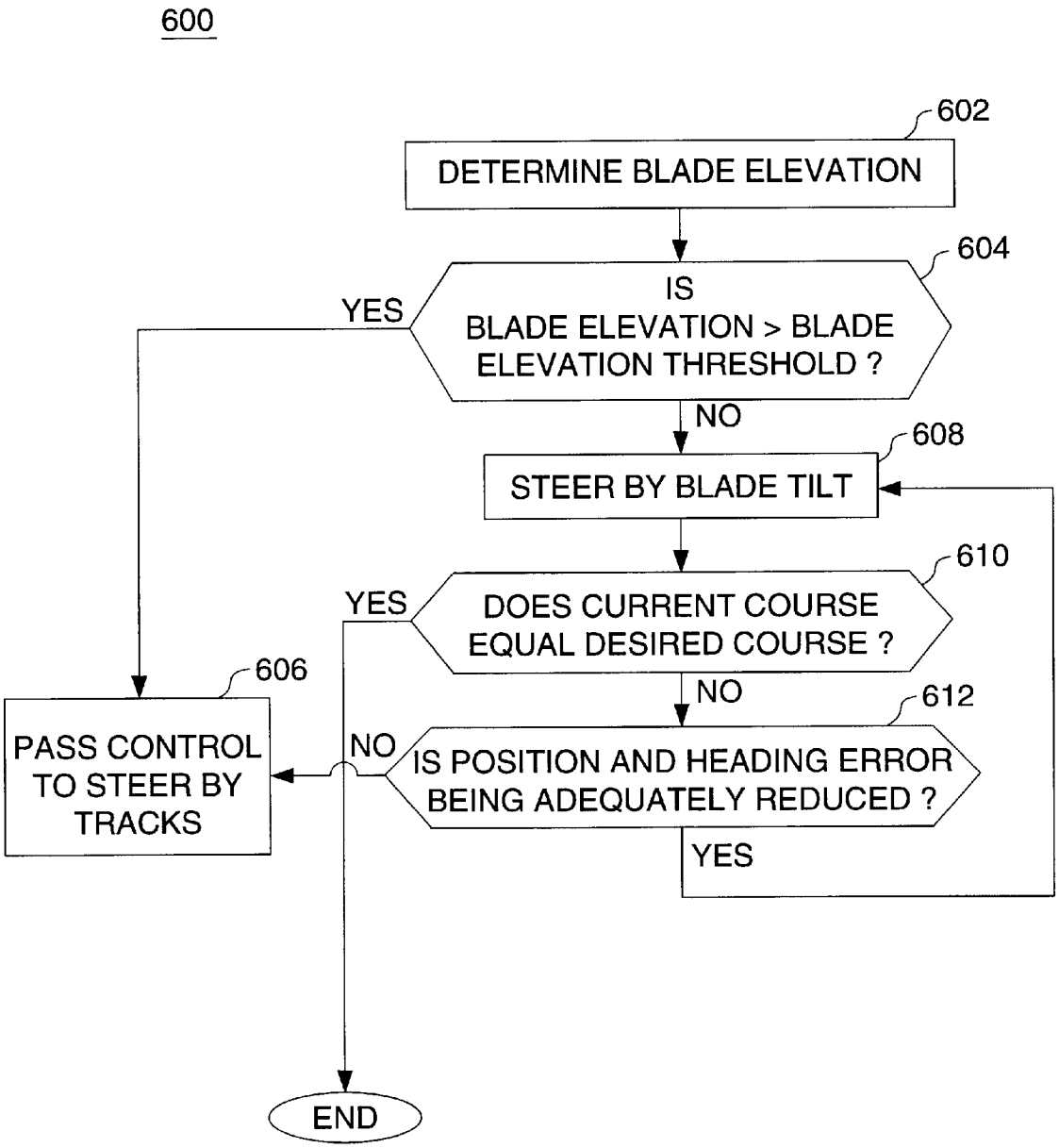
FIG. 6 is a flow diagram illustrating an expanded view of the flow of a determination to use blade tilt steering.

For a better understanding of the present invention, the seventh control block 420, steering by blade tilt, is more fully described in FIG. 6. In a first control block 602, the elevation of the blade 104 is determined. Control then proceeds to a first decision block 604 to determine whether the blade elevation is greater than a blade elevation threshold. If the blade elevation is greater than a blade elevation threshold, then control proceeds to the second control block 606 to use differential track speed steering to correct the position or heading error. Control is then passed to the sixth control block 418, shown in FIG. 4, to perform differential track speed steering. In the preferred embodiment, the blade elevation threshold is an elevation slightly above ground. That is, if the blade is elevated a large distance above the ground, then it is more efficient to use differential track speed steering to make position corrections than to lower and engage the blade with the ground in order to use blade tilt steering. Another example of a blade elevation threshold setting is simply at ground level. That is if the blade 104 is in the ground, then blade tilt steering is used to correct for position and heading errors. If the blade 104 is above the ground, then differential track speed steering is used to correct for position and heading errors. Therefore, if the blade elevation is less than a blade elevation threshold, then control is passed to a third control block 608 and blade tilt steering is used to correct position and heading errors.

After steering by blade tilt in the third control block 608, control then passes to a second decision block 610 to determine if the machine 102 has returned to the desired path and heading. The second decision block 610 includes the steps of, (discussed earlier relative to FIG. 4): updating the current position and heading; updating the desired position and heading relative to the updated current position and heading; and determining if either the difference between the current and desired position, or the difference between the current and desired heading exceed a position or heading threshold respectively. If the machine 102 has returned to the desired path and heading then control proceeds to the end of the method 600. If the machine 102 has not returned to the desired path and heading, then control passes to a third decision block 612. In the third decision block 612 a decision is made as to whether the position and heading error are being reduced quickly enough. If using blade tilt steering is not correcting the error fast enough, then control is passed to the second control block 606 where the determination is made to use differential track speed steering, instead of blade tilt steering. In the preferred embodiment, the transition from blade tilt steering to differential track speed steering involves returning the blade 104 to the necessary position to perform the currently required function, whether the blade is located in the ground engaged in dozing, or located above the ground. Control is then passed to the fifth control block 418, shown in FIG. 4, to perform differential track speed steering.

In the preferred embodiment, the error correction rate is determined by monitoring the position update and the time interval between the updates. For example, if the previous and current position updates indicate the error has been reduced from 0.5 meters to 0.3 meters in one time increment, eg, 1 second, then a determination may be made that the error is being adequately reduced and the machine 102 can continue to utilize blade tilt steering for correction. However, if the error has been reduced from 0.5 meters to 0.49 meters in the same time increment, then the error is not being reduced quickly enough and the steering technique is changed to differential track speed steering. The faster the machine 102 is moving, the more the error should be reduced in one time increment. If blade tilt steering is correcting the error fast enough, then control is returned to the third control block 608 to continue blade tilt steering. The method 600 continues until either control is passed to perform differential track speed steering, or the position and heading error has been reduced to an acceptable value, or eliminated.

Figure 7:
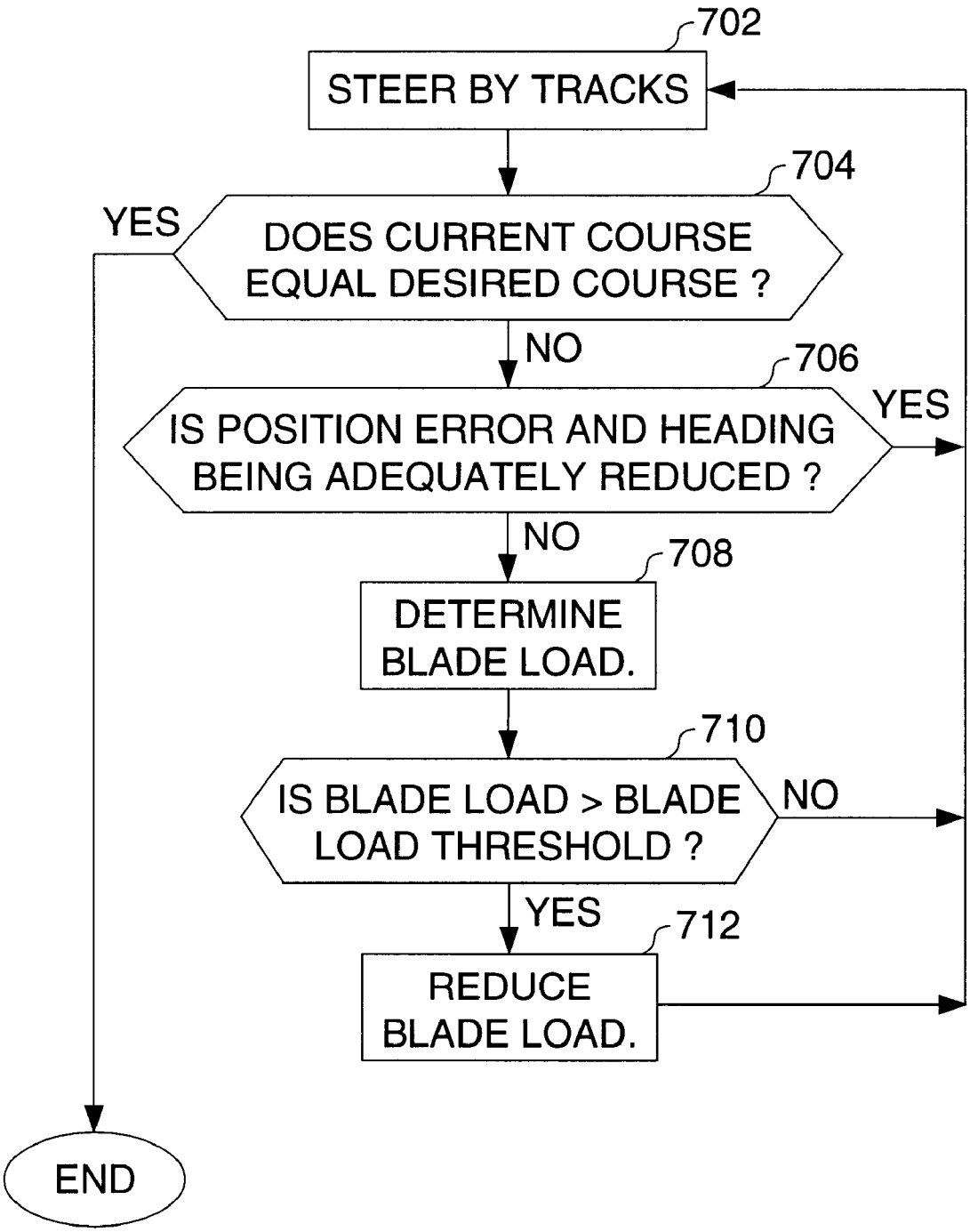
FIG. 7 is a flow diagram illustrating an expanded view of the flow of a determination to use differential track speed steering.

In the preferred embodiment, the fifth control block 418 of the method 400, shown in FIG. 4, is expanded as shown in FIG. 7. In the first control block 702 the machine 102 is steered using differential track speed steering. Control then passes to a first decision block 704 to determine if the machine 102 has returned to the desired path and heading. The first decision block 704 includes the steps, discussed earlier relative to FIG. 4, of updating the current position and heading, updating the desired position and heading relative to the updated current position and heading, and determining if either the difference between the current and desired position, or the difference between the current and desired heading exceed a position or heading respectively. If the machine 102 has returned to the desired path and heading then control proceeds to the end of the method 700. If the machine 102 has not returned to the desired path and heading, then control proceeds to a second decision block 706 to determine if the position and heading error is being adequately reduced. If the error is being reduced fast enough then control proceeds to the first control block 702 to continue to steer by differential track speed to reduce the position error. However, if the error is not being reduced fast enough, control proceeds to a second control block 708 to determine the load of the blade. For example, if the blade 104 is raised above a predetermined height and not being used by the machine 102 to push anything, then the blade load would be approximately zero, or close to it. However, if the blade 104 is engaged with the ground and being used to push soil, a load is placed upon the blade 104. There are several existing methods to determine blade load, including measuring engine torque, tractive force, or the pump pressure of the lift cylinders. In the preferred embodiment, blade load is determined by determining the traction force via the engine torque. After determining the blade load, control is passed to a third decision block 710. In the third decision block 710 if the blade load exceeds a blade load threshold, then control is passed to a third control block 712. In the third control block 712 the blade load is reduced to a level below the blade load threshold.

The steps shown in FIG. 7 of determining the blade load 708, determining if the blade load exceeds the blade load threshold 710, and reducing the blade load if necessary 712, addresses the condition where the blade load exceeds the maximum tractive force of the machine 102, causing slippage between the tracks of the machine 102 and the ground. Such a condition creates inefficient operation of the machine 102. One method of reducing blade load is simply to raise the blade to reduce the volume of material the blade 104 is pushing. Once the blade load is reduced to an acceptable value, then control is passed to the first control block 702 to continue using differential track speed steering. The method 700 continues until the position or heading error has been reduced to an acceptable value, or eliminated.

Figure 8:
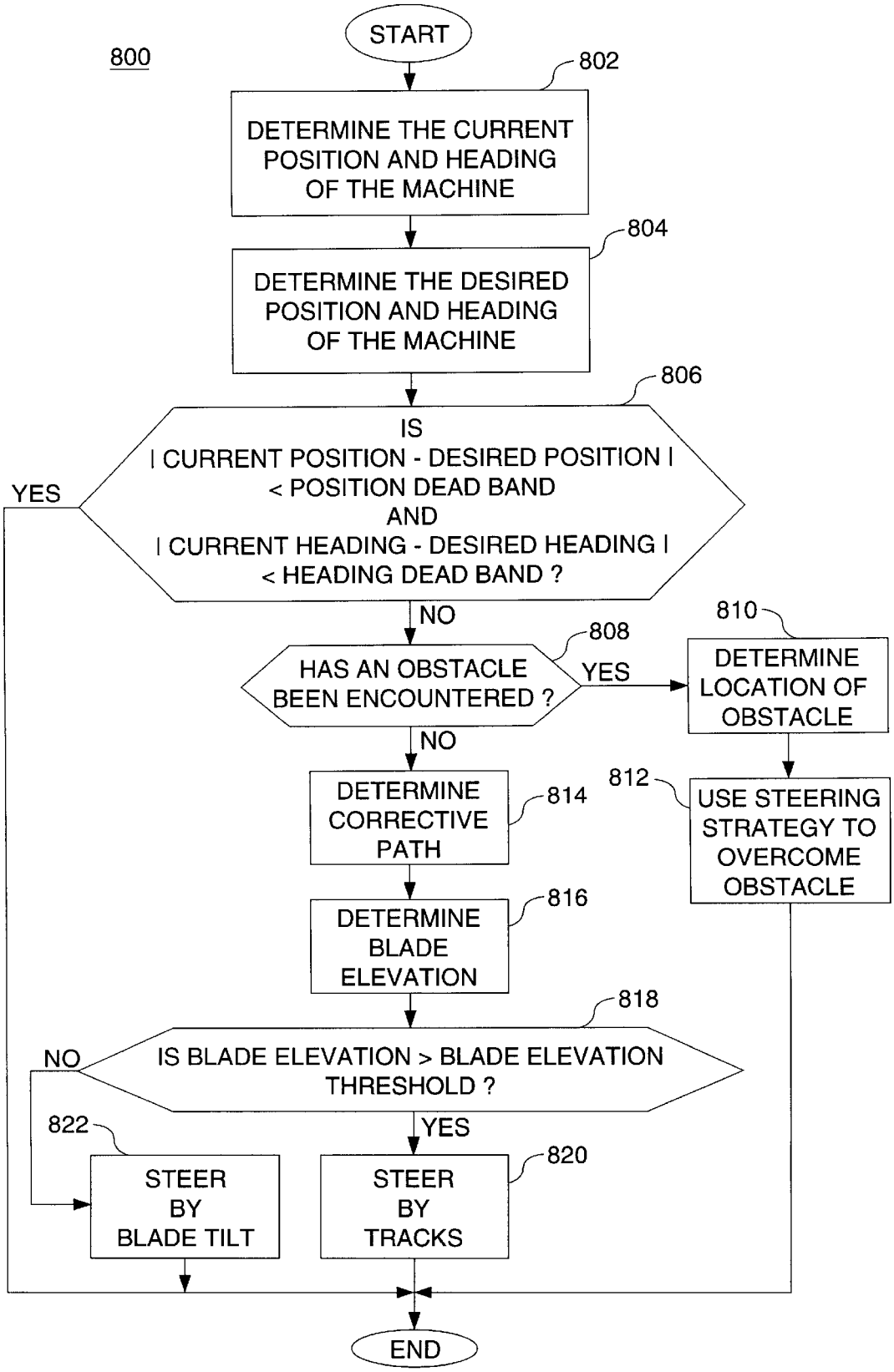
FIG. 8 is flow diagram illustrating a second embodiment of the present invention.

An alternative embodiment of the present invention is described in the method 800 illustrated in FIG. 8. In a first control block 902 the current position and heading of the machine 102 are determined by the positioning system 208. Control then passes to a second control block 804 where the desired position and heading of the machine 102 are determined. As described earlier with regard to the method 400 of FIG. 4, the desired position and heading are determined by the route monitor 210 and communicated to the steering controller 202.

In a first decision block 806 the current position is compared with the desired position. In addition, the current heading is compared with the desired heading. If the difference between the current and desired position is less than a position deadband, and if the difference between the current and desired heading is less than an heading deadband, then no correction for either the position or the heading is currently needed. Consequently control passes to the end of the method 800. The position difference deadband and the heading difference deadband represent minimum values that should be exceeded before corrective action is deemed to be necessary. Once control reaches the end of the method 800, the method 800 is repeated.

However, if the position difference is not less than a position deadband, or the heading difference is not less than an heading deadband, then control passes to a second decision block 808 to determine if the machine 102 has encountered an obstacle.

Methods to detect whether an obstacle has been encountered include monitoring the position and heading of the machine 102, and the load of the engine of the machine 102. If there is a sudden and substantial change in the heading from the previous reading to the current reading with little or no change in the position reading, then there is a strong likelihood that an obstacle has been encountered.

If the blade 104 encounters a rock located in the middle portion of the blade 104, the most noticeable result may be an increase in engine load as the machine 104 attempts to drive through the rock. Therefore, if either of these conditions exist, an sudden increase in engine load, or a sudden change in heading, then a determination is made that an obstacle has been encountered and control proceeds to a third control block 810 to determine the location of the obstacle.

In a third control block 810 a simple determination is made regarding the location of the obstacle relative to the blade 104. If the heading changed suddenly, then the determination is made that the rock is located on the side of the blade 104 that the machine 102 is turning towards. For example, as stated above, if the machine 102 is rotating to the left, then the assumption is that the rock is located on the left portion of the blade 104.

If the machine 102 is experiencing a sudden change in the engine load, then the assumption is that the rock is located in the middle portion of the blade. Once the determination is made regarding the location of the rock, then control proceeds to a fourth control block 812 to use an appropriate steering strategy, based upon the location of the rock, to overcome the rock. The process of using an appropriate steering strategy in the fourth control block 812 is the same as the fourth control block 412 of the method 400, shown in FIG. 4.

When an obstacle is encountered, such as a rock, unless the obstacle is successfully removed, eg., digging out the rock, then the machine 102 transmits information to the operator, either on-board or off board, indicating the location of the obstacle so that other measures can be taken to remove the obstacle.

Referring again to the second decision block 808, if an obstacle has not been encountered, then control proceeds to a fifth control block 814, and a corrective path is determined. In the fifth control block 814 a corrective path for the earth moving machine 102 is determined. As described earlier and illustrated in FIG. 5, a corrective path 510 is determined that will enable the machine 102 to return to the desired path by using the smoothest path 510, not necessarily the shortest path 512. In addition, as described earlier, in the preferred embodiment, the third control block includes the step of determining if a maximum error threshold was exceeded. If the maximum error threshold was exceeded a warning flag is set to indicate a significant problem has occurred with the machine guidance system. Referring to FIG. 8, once a corrective path is determined, control then passes to a sixth control block 816 to determine blade elevation. Once the blade elevation is determined control proceeds to a third decision block 818. In the third decision block 818 a comparison is made between the blade elevation and a blade threshold elevation. If the blade elevation is greater than the blade elevation threshold, then control is passed to a eighth control block 820 and differential track speed steering is used to correct the position or heading error. However, if the blade elevation is not greater than the blade elevation threshold then control passes to a seventh control block 822, and blade tilt steering is used to correct the position or heading error. In either case, the use of blade tilt steering or differential track speed steering the steering technique is continued until the error is reduced to an acceptable level, or eliminated.

Figure 9:
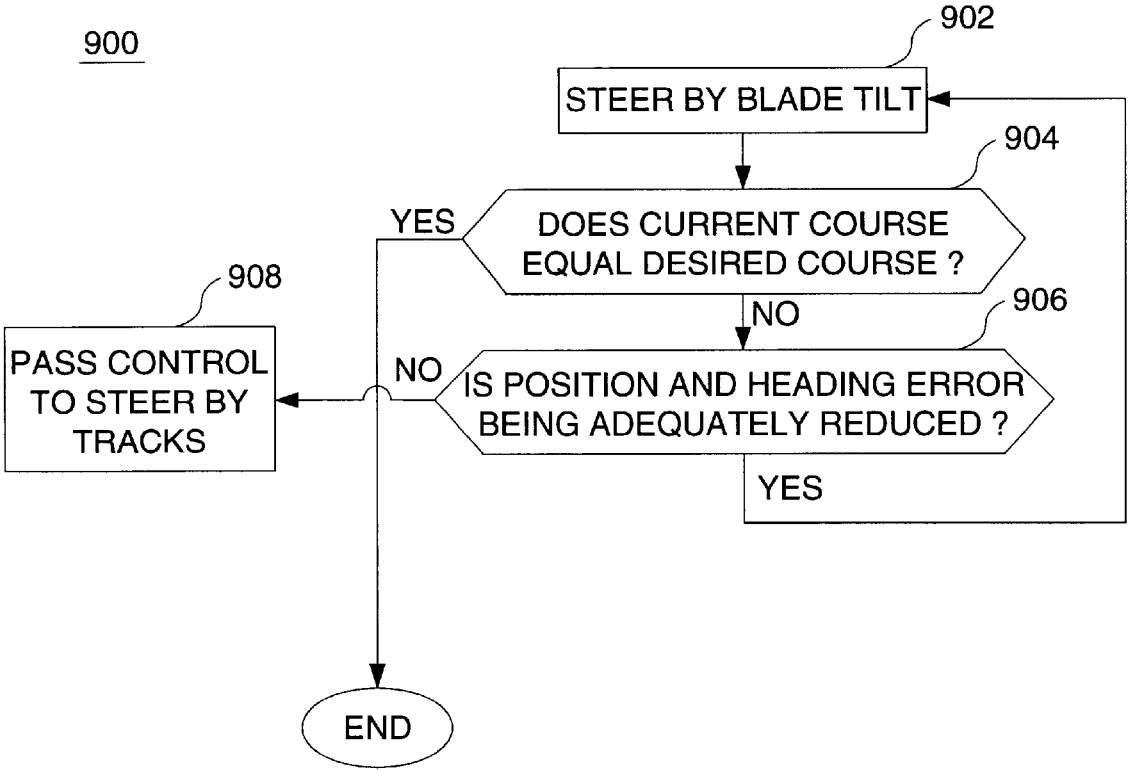
FIG. 9 is a flow diagram illustrating one embodiment of a method used to determine when to use blade tilt steering.

In the preferred embodiment, the seventh control block 822 is expanded to include the steps shown in FIG. 9. In a first control block 902 steering by blade tilt is used to correct the position or heading error. Control then passes to a first decision block 904 to determine if the machine 102 has returned to the desired path and heading. The first decision block 904 includes the steps, discussed earlier relative to FIG. 8, of updating the current position and heading, updating the desired position and heading relative to the updated current position and heading, and determining if either the difference between the current and desired position, or the difference between the current and desired heading exceed a position or heading respectively. If the machine 102 has returned to the desired path then control proceeds to the end of the method 900. If the machine 102 has not returned to the desired path then control passes to a second decision block 906. In the second decision block 906 a decision is made as to whether the position and heading error are being reduced quickly enough. If using blade tilt steering is not correcting the error fast enough, then control is passed to the second control block 908 where the determination is made to use differential track speed steering, instead of blade tilt steering. In the preferred embodiment, the transition from blade tilt steering to differential track speed steering involves returning the blade 104 to its necessary position to perform the currently required function, whether the blade is located in the ground engaged in dozing, or located above the ground. Control is then passed to the eighth control block 820, shown in FIG. 8, to perform differential track speed steering. If the position and heading error are being reduced quickly enough, then control is passed to the first control block 902 to repeat the steering by blade tilt process. The steering by blade tilt process is repeated until either control is passed to perform differential track speed steering, or the position or heading error has been reduced to an acceptable value, or eliminated.

In the preferred embodiment, the eighth control block 820 of the method 800, shown in FIG. 8, is expanded as shown in FIG. 7. The method 700 continues until the position and heading error has been reduced to an acceptable value, or eliminated.

The primary difference between the two embodiments of the present invention, illustrated in FIG. 4 and FIG. 8 respectively, is that the embodiment of the present invention illustrated in FIG. 4 uses the magnitude of the position and heading difference to make the initial determination regarding selection of steering technique. However, the embodiment of the present invention shown in FIG. 8 uses the elevation of the blade 104 to make the initial determination regarding steering technique. The premise of the embodiment shown in FIG. 8 is that initially blade tilt steering will be used to correct the position and heading error, if the blade is either in the ground already, or elevated a small distance above the ground.

INDUSTRIAL APPLICABILITY

With reference to the drawings and in operation, the present invention provides a method for selecting a steering method for an earthmoving machine having a blade and first and second tracks. One embodiment of the present invention includes selecting a steering method based on the position and heading error of the machine. In another embodiment of the present invention the steering method is selected based on the elevation of the work implement, and the position and heading difference.

The present invention is capable of operating on a earth moving machine 102 that is manually operated, or operated semi-autonomously or autonomously. In one embodiment of manual operation a display (not shown) is provided. In one embodiment of the present invention used during manual operation, the present invention displays to the operator a steering recommendation. The steering recommendation is based on the selected steering technique, and associated information. The steering recommendation includes the current position and heading error, the recommended steering technique to use to overcome the error, and the corrective path to take to converge with the desired path. Based on the displayed steering recommendation the operator attempts to reduce the position and heading error of the machine 102.

The ultimate goal of the present invention is to enable the earth moving machine 102 to operate in a land site in the most efficient manner. The present invention is capable of operating on a mobile machine 102 which is part of a multi-machine operation working on a land site. One advantage of selecting a steering method based on position and heading error and blade elevation is that the method addresses the immediate problem of correcting a position and heading error, which on a land site is a critical element during the manipulation of the land site. Correction of position and heading errors while manipulating a land site is especially important when multiple machines are operating autonomously on the land site.

Other aspects, objects, advantages and uses of the present invention can be obtained from a study of the drawings, disclosures and appended claims.

We claim:

1. A method for steering an earthmoving machine having a blade and a first and second track comprising:

determining a current position of said earth moving machine;

determining a desired position of said earth moving machine;

comparing said current position and said desired position and responsively determining a position difference; and selecting a steering technique for steering said machine in response to said position difference, said steering technique being one of a blade tilt steering and a differential track speed steering.

2. A method, as set forth in claim 1, wherein the step of determining said current position of said earth moving machine includes the step of determining a current heading of said earth moving machine, and the step of determining said desired position of said earth moving machine includes the step of determining a desired heading of said earth moving machine, and the step of comparing said current position and said desired position includes the step of comparing said current heading and said desired heading and responsively determining a heading difference, said position difference including said heading difference.

3. A method, as set forth in claim 1, wherein the step of selecting said steering technique includes the steps of:

selecting said differential track speed steering in response to a magnitude of said position difference being greater than a position error threshold; and selecting said blade tilt steering in response to said position difference magnitude being one of less than and equal to said position error threshold.

4. A method, as set forth in claim 1, wherein the step of selecting said steering technique includes the steps of:

determining an elevation of said blade;

selecting said differential track speed steering in response to a magnitude of said position difference being greater than a position error threshold;

selecting said differential track speed steering in response to said position difference magnitude being one of less than and equal to said position error threshold, and said blade elevation being greater than an blade elevation threshold; and selecting said blade tilt steering in response to said position difference magnitude being one of less than and equal to said position error threshold, and said blade elevation being one of less than and equal to said blade elevation threshold.

5. A method, as set forth in claim 1, wherein the step of steering said earth moving machine by differential track steering includes the steps of:

determining a blade load on said blade; and comparing said blade load and a blade load threshold and responsively reducing said blade load in response to said blade load being greater than said blade load threshold.

6. A method, as set forth in claim 1, wherein the step of determining said position difference includes the steps of:

comparing said position difference to a maximum position error;

setting a warning flag in response to said comparison; and displaying a position error message to at least one of a on board and an off board operator.

7. A method, as set forth in claim 1, further comprising the steps of:

determining a current heading of said earth moving machine;

determining a desired heading of said earth moving machine;

comparing said current heading and said desired heading and responsively determining a heading difference; and wherein the step of selecting a steering technique includes the step of steering said earthmoving machine by one of said blade tilt steering and said differential track speed steering in response to said position difference and said heading difference.

8. A method, as set forth in claim 7, further comprising the steps of:

selecting said differential track speed steering technique in response to said position difference;

determining an obstacle has been encountered; and determining a steering strategy to overcome said obstacle.

9. A method, as set forth in claim 8, wherein the step of determining a steering strategy includes the selection of at least one of, going over the obstacle, going around the obstacle, digging out the obstacle, and cutting through the obstacle.

10. A method, as set forth in claim 8, wherein the step of determining said obstacle has been encountered further comprises the steps of:

determining said obstacle has been encountered in response to at least one of said position, said heading, and an engine load of said machine; and determining a location of said obstacle relative to said blade in response to said at least one of said position, said heading, and said engine load.

11. A method, as set forth in claim 1, further comprising the step of:

selecting said blade tilt steering technique in response to said position difference;

updating said current position;

determining a time interval of said position update;

determining an position change in response to said position and said position update; and determining an error correction rate in response to said position change and said update time interval; and selecting one of said blade tilt steering and said differential track speed steering in response to said error correction rate.

12. A method for automatically steering an earthmoving machine having a blade and a first and second track, comprising:

determining a current position of said earth moving machine;

determining a desired position of said earth moving machine;

comparing said current position and said desired position and responsively determining a position difference;

determining a elevation of said blade;

comparing said blade elevation and a blade elevation threshold and responsively determining a blade elevation difference; and, steering said earthmoving machine by one of said blade tilt steering and said differential track speed steering, in response to said position difference and said blade elevation difference.

13. A method, as set forth in claim 12, further comprising the steps of:

determining a current heading of said earth moving machine;

determining a desired heading of said earth moving machine;

comparing said current heading and said desired heading and responsively determining a heading difference; and wherein the step of steering said machine includes the step of steering said earthmoving machine by one of said blade tilt steering and said differential track speed steering in response to said position difference and said heading difference.

14. A method, as set forth in claim 13, wherein the step of steering said machine includes the steps of:

steering said earth moving machine by differential track speed steering in response to said blade elevation being greater than said blade elevation threshold; and steering said earth moving machine by blade tilt steering in response to said blade elevation being one of less than and equal to said blade elevation threshold.

15. A method, as set forth in claim 14, wherein the step of steering by differential track speed includes the steps of:

determining an obstacle has been encountered; and determining a steering strategy to overcome said obstacle.

16. A method, as set forth in claim 15, wherein the step of determining a steering strategy includes the selection of at least one of, going over the obstacle, going around the obstacle, digging out the obstacle, and cutting through the obstacle.

17. A method, as set forth in claim 16, wherein the step of determining said position difference includes the steps of:

comparing said position difference to a maximum position error;

setting a warning flag in response to said comparison; and displaying a position error message to at least one of a on board and an off board operator.

18. A method for steering an earthmoving machine having a blade and a first and second track comprising:

determining a current position of said earth moving machine;

determining a desired position of said earth moving machine;

comparing said current position and said desired position and responsively determining a position difference;

determining a steering technique, said steering technique including at least one of a blade tilt steering and a differential track speed steering in response to said position difference; and displaying a steering recommendation to an operator based upon said steering technique.

19. A method for steering an earthmoving machine having a blade and a first and second track, comprising:

determining a current position of said earth moving machine;

determining a desired position of said earth moving machine;

comparing said current position and said desired position and responsively determining a position difference;

determining a elevation of said blade;

comparing said elevation of said blade and a blade elevation threshold and responsively determining a blade elevation difference;

determining a steering technique, said steering technique comprised of at least one of a blade tilt steering and a differential track speed steering, in response to said position difference and said blade elevation difference; and displaying a steering recommendation to an operator in response to said steering technique.

* * * * *